United States Patent [19]

Waltemyer et al.

[11] Patent Number: 4,682,467

[45] Date of Patent: Jul. 28, 1987

[54] CHAIN FORMING METHOD AND APPARATUS

[75] Inventors: Ronald G. Waltemyer; Royce L. Brown, both of York, Pa.

[73] Assignee: Cooper Industries, Inc., Houston, Tex.

[21] Appl. No.: 701,851

[22] Filed: Feb. 13, 1985

[51] Int. Cl.[4] ..... B21L 15/00

[52] U.S. Cl. ..... 59/30; 59/35.1; 59/84

[58] Field of Search ..... 59/29, 30, 35.1, 78, 59/84, 90, 3, 85, 80, 93; 72/401, 402, 389

[56] References Cited

U.S. PATENT DOCUMENTS

| | | | |
|---|---|---|---|
| 1,812,052 | 6/1931 | Lamb . | |
| 2,302,263 | 11/1942 | Schneck | 59/35.1 |
| 2,579,394 | 12/1951 | Nordenson et al. | 59/35.1 |
| 2,601,575 | 6/1952 | Weinacker et al. | 59/80 |
| 2,895,290 | 7/1959 | Devonshire | 59/90 |
| 2,903,767 | 9/1959 | Huber | 24/116 |
| 3,913,374 | 10/1975 | Esser et al. | 72/404 |
| 4,068,467 | 1/1978 | Schreyer et al. | 59/93 |
| 4,428,186 | 1/1984 | Hedren et al. | 59/16 |

FOREIGN PATENT DOCUMENTS

| | | | |
|---|---|---|---|
| 16953 | of 1909 | United Kingdom | 59/85 |

*Primary Examiner*—Robert L. Spruill
*Assistant Examiner*—David B. Jones
*Attorney, Agent, or Firm*—E. E. Scott; A. R. Thiele

[57] ABSTRACT

A method for producing oriented, one-way links from a stock chain having first and second rounded ends and parallel spaced straight sides. The method comprises: moving the chain to a first forming station; forming protuberances in each straight side adjacent the first end of at least a single first link at the first station, the protuberances extending laterally outwardly from the at least on first link; moving the chain to a second forming station; rotating the chain; forming protuberlances one each straight side adjacent the first end of at least a single second link orthogonal to the first link at the second station, the protuberances extending laterally outwardly from the at least one second link; and repeating the above step until all links of the chain have protuberances formed therein. The apparatus comprises: a first forming station; an indexing sprocket for moving the chain to the first forming station; an indentation press for forming protuberances in each straight side section adjacent the first end of at least a single first link at the first station, the protuberances extending laterally outwardly from the at least one first link; a second forming station; a second indexing sprocket for moving the chain to the second forming station; and a second indentation press for forming protuberances on each straight side section adjacent the first end of at least a single second link orthogonal to the first link at the second station, the protuberances extending laterally outwardly from the at least one second link.

26 Claims, 11 Drawing Figures

CHAIN FORMING METHOD AND APPARATUS

BACKGROUND OF THE INVENTION

1. Field of the Invention

The present invention relates to chain forming apparatus and method for using same, and more particularly, to a chain forming apparatus and method for producing oriented, one way links in a chain.

2. Description of the Prior Art

A one way chain is a chain which has oriented, one-way links which are employed to secure an oriented link within a pocket of an associated tensioning device. In such a tensioning device, a chain link is received within a pocket which positions the received link so that the generally parallel straight side portions thereof are at an obtuse angle to the longitudinal axis of the next link closest to a load.

The pockets in the tensioning device are intended to position the arcuate end portion of the link nearest the load of the received link at, or near the longitudinal axis of the tensioning device.

If properly employed, the positioning of the arcuate end portion of the line nearest the load of the received link concentrates the forces on the tensioning device near its longitudinal axis.

If the chain is improperly connected to the tensioning device by placing the arcuate end portion furthest from the load of the received link near the longitudinal axis of the device, the line of forces creates a moment on the device which is undesirable and greater bending forces are concentrated on the chain link.

Neither the chain link nor the tensioning devices have as high a strength with improper loading; and improper loading can result in an unanticipated and premature release of the load.

It has been recognized that an oriented link which only can be received in the pocket in one direction can be used to ensure that the arcuate end portion of the link nearest the load was correctly positioned. This oriented link can be established by providing a pear-shaped link or by putting a large single weld on one of the straight portions of a link adjacent to the arcuate end. However, it is desirable to produce an oriented link on a conventional roll forming machine to reduce the price of the chain and to enable different types and sizes of chain to be used.

Heretofore various methods and apparatus have been proposed for processing chain. Examples of such methods and apparatus can be found in the following U.S. Patents:

| U.S. PAT. NO. | PATENTEE |
|---|---|
| 1,812,052 | Lamb |
| 2,895,290 | Devonshire et al. |
| 3,913,374 | Esser et al. |
| 4,428,186 | Hedren et al. |

The Lamb U.S. Pat. No. 1,812,052 discloses a method of making chain and apparatus therefor. This patent discloses an apparatus for beading and forming wire from coiled stock into a completed chain.

The Devonshire et al. U.S. Pat. No. 2,895,290 discloses a chain link having identification and a replacement gauging means. This patent discloses a method for permanently making chains for purposes of visual identification by placing a symbol on one leg or straight side portion of a link by compressing and deforming each link.

The Esser et al. U.S. Pat. No. 3,913,374 discloses an apparatus for bevelling wire blanks. This patent discloses an apparatus which bevels wire blanks to ensure a better weld when such blanks are subsequently formed into a chain.

The Hedren et al. U.S. Pat. No. 4,428,186 discloses a chain making apparatus. This patent discloses an apparatus for the manufacture of several chains at a time by flash welding.

The apparatus of the present invention is used to manufacture a one-way chain which has oriented links. The one-way function is achieved by forming a protuberant detent on each straight side portion of a link near one arcuate or rounded end of the link. The forming of the protuberances, the width sizing of each link and the trimming of the interior weld of each link is performed by the apparatus in conjunction with a conventional automatic roll forming machine which greatly reduces manufacturing time and cost of the chain.

Moreover, the method of the present invention differs from the previously proposed method by providing a method for mass producing oriented, one-way links from a regular chain.

SUMMARY OF THE INVENTION

According to the invention there is provided a method for producing oriented, one-way links from a stock chain of the type including oval shaped links each having first and second rounded ends and parallel spaced straight side sections, said method comprising the steps of:

moving the chain to a first forming station;

forming protuberances in each straight side section adjacent the first end of at least a single first link at said first station, the protuberances extending laterally outwardly from the at least one first link;

moving the chain to a second forming station;

rotating the chain;

forming protuberances on each straight side section adjacent the first end of at least a single second link orthogonal to the first link at the second station, the detents extending laterally outwardly from the at least one second link; and repeating the above step until all links of the chain have protuberances formed therein.

Also according to the invention there is provided an apparatus for producing oriented, one-way links from a stock chain of the type including oval shaped links each having first and second rounded ends and parallel spaced straight side sections, said apparatus comprising:

a first forming station;

means for moving the chain to said first forming station;

means for forming protuberances in each straight side section adjacent the first end of at least a single first link at said first station, the protuberances extending laterally outwardly from the at least one first link;

a second forming station;

means for moving the chain to said second forming station; and means for forming protuberances on each straight side section adjacent the first end of at least a single second link orthogonal to the first link at said second station, the protuberances extending laterally outwardly from the at least one second link.

Further according to the invention there is provided a chain made by the method described above.

Preferably three links in one plane are formed with protuberances at the first forming station and three adjacent orthogonal links in a plane 90° to the first plane are formed with protuberances at the second forming station.

Further according to the invention there is provided in the apparatus, two novel, identical forming presses which have dies and mechanisms for causing in one cycle of operation indexing of a section of chain, locating of the section of chain, forming of protuberances in each link straight section adjacent one end of three respective links, while at the same time forming to size the width of three links already having protuberances formed therein and trimming any weld within the oval interior of each of those links simultaneously.

DESCRIPTION OF THE PREFERRED EMBODIMENT

Figure 1:
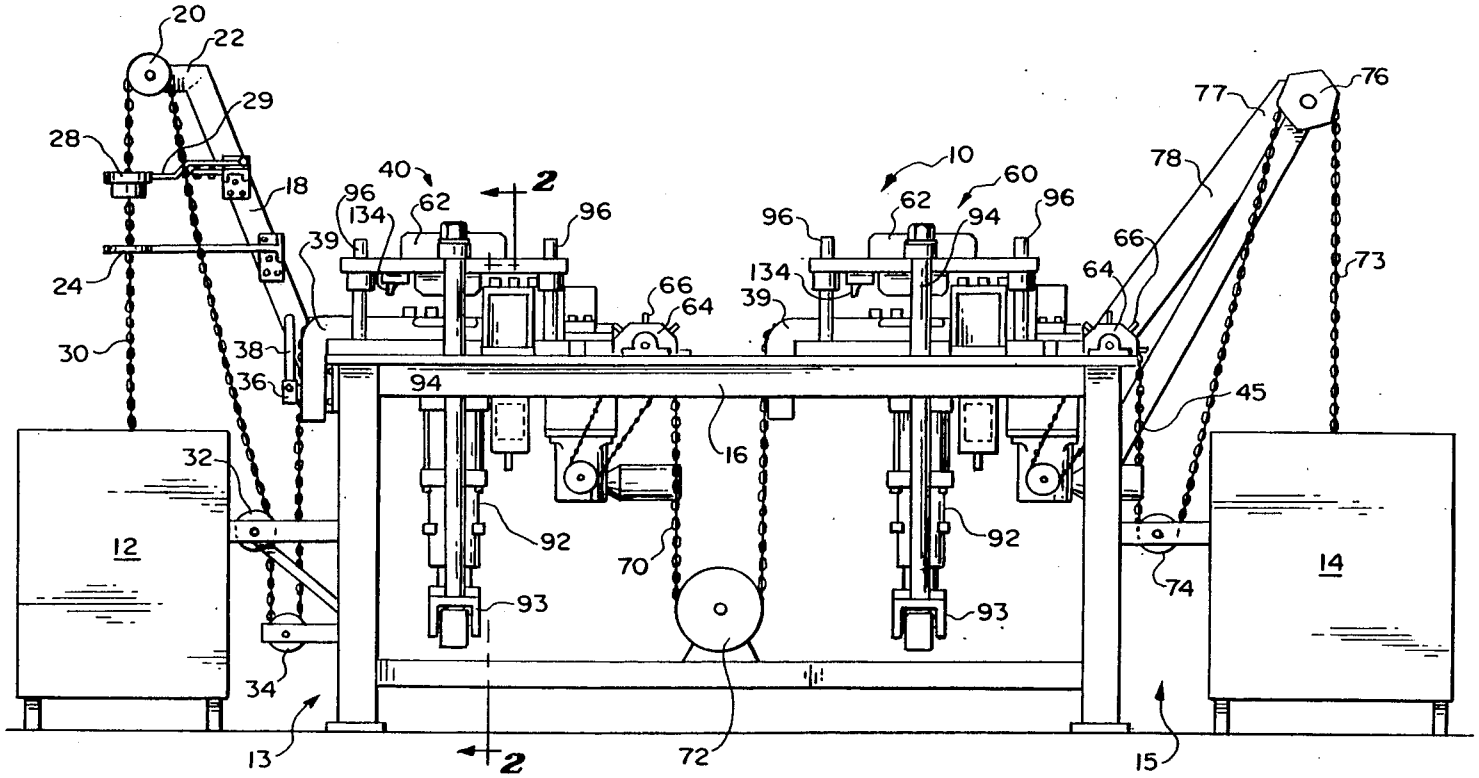
FIG. 1 is a side elevational view of the chain forming apparatus of the present invention.

Referring now to the drawings in greater detail there is illustrated in FIG. 1 a chain forming apparatus 10 constructed according to the teachings of the present invention. The apparatus 10 is provided with a feeder container 12 at one end 13 (left side of FIG. 1) and a storage container 14 at the other end 15 (right side of FIG. 1). On one end is forming station 40 and on the other end is substantially identical forming station 60. Where needed for ease of description, components of forming station 60 will be annotated with a prime symbol.

The apparatus 10 includes a framework 16 mounting various mechanisms of the apparatus 10. As shown an arm 18 extends outwardly and upwardly from the framework 16 at the end 13 of the apparatus 10. A pulley 20 is mounted at an upper end 22 of the arm 18. A knot detector guide 24 is mounted at the distal end of a first lower strut 26 fixed to and extending horizontally outwardly from the arm 18 and a chain orientation and snag sensor ring 28 is mounted at the distal end of a second upper strut 29 fixed to and extending horizontally outwardly from the arm 18.

Figure 3A:
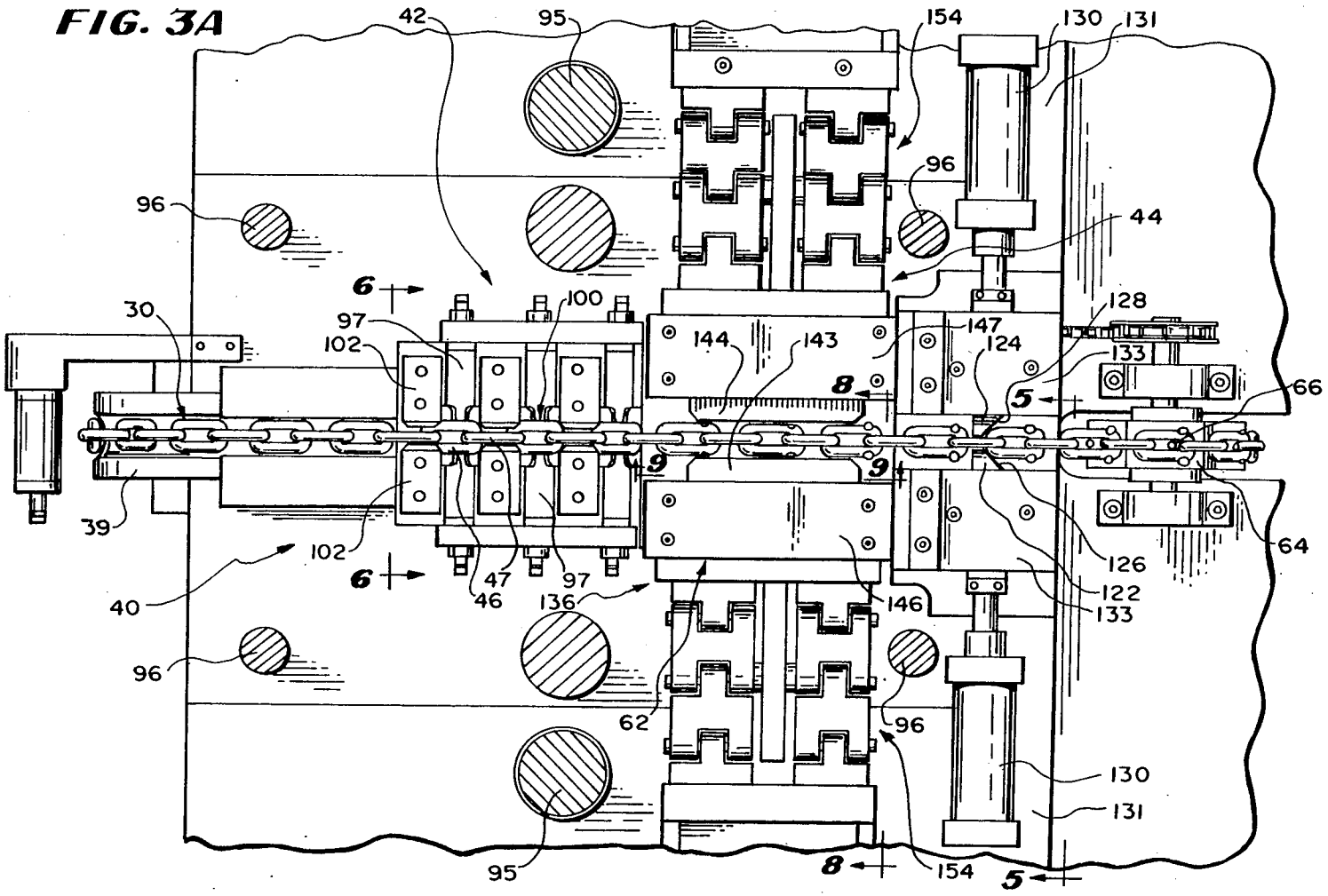
FIG. 3A is part of a horizontal sectional view of the apparatus shown in FIG. 1, is taken along line 3—3 of FIG. 2, and shows a forming station at one end of the apparatus.

A chain 30 is fed from the container 12 through the guide 24 and the sensor 28 and over the pulley 20. From there the chain 30 extends downwardly over a guide pulley 32 and under another guide pulley 34, both of which are supported by the framework 16. Then the chain 30 is fed upwardly through a friction block 36 having a lever arm 38 and over a rounded grooved chain guide 39 (which could have a sprocket therein) and into a first forming station 40 having two work stations 42 and 44 (FIG. 3A).

Figure 10:
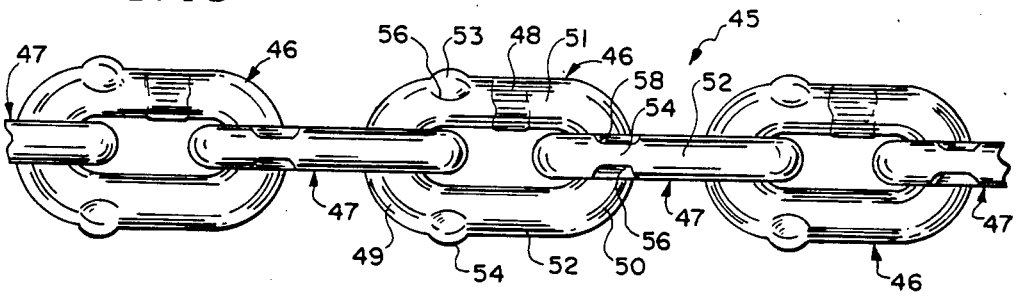
FIG. 10 is a plan view of the chain formed by the apparatus shown in FIG. 1.

As shown in FIG. 10, a finished chain 45 is made from the chain 30 which is of the type having first horizontal links 46 and adjacent orthogonal vertical second links 47. Each link 46 or 47 is formed from flattened stock that had been formed into an oval and butt welded at the ends thereof with a weld 48. In this way, each link 46 and adjacent link 47 has a first rounded end 49 and a second rounded end 50 and parallel spaced straight sections 51 and 52. The links 47 are orthongonal or 90° to adjacent links 46.

The apparatus 10 is operable according to the method of the present invention first to form detents or protuberances 53 and 54 in the straight sections 51 and 52, respectively, adjacent the first end 49 of the first links 46 and second to form protuberance 53 and 54 in the straight section 51 and 52, respectively, adjacent the first end 49 of the second links 47. Each protuberance 53 and 54 is formed by pressing or punching a straight section 51 or 52 of horizontal links 46, at the first work station 42, between two opposed, upper and lower semicircular dies which form semicircular indentations 56 and 58 on each side of each protuberance 53 or 54. The forming of identations 56, 58 squeezes out metal to form protuberances 53, 54.

The links 47 are formed with protuberance 53 and 54 at a second forming station 60 mounted on the framework 16 as will be desribed in greater detail hereinafter.

At the same time, protuberances 53,54 are being formed at the first work station 42 and 42' within each of the two forming stations 40 or 60, a section of chain 30 in which protuberances 53 an 54 have already been formed are sized relative to the width of each link 46 (or 47) and trimmed of excess weld material within each link 46 (or 47), at the second work station 44 or 44'. In the illustrated embodiment of apparatus 10, three links are formed with protuberances while three preceeding links are sized and trimmed in one cycle of operation of a multifacet press 62 or 62' at the forming stations 40 or 60 respectively.

As will be described in greater detail hereinafter, a section of the chain 30 is first located in the press 62, in part by a driven index sprocket 64 having chain engaging pins 66, and then a simultaneous protuberance forming on three horizontal links 46, and width sizing and interior weld trimming on the preceeding three horizontal links is performed on six links in the section of chain 30 in the press 62.

Then by prior initializing of the chain 30 with a 90° twist in a portion 70 thereof between the index sprocket 64 and the second forming station 60, the chain 30 is rotated 90° so that the second adjacent links 47 in another section of chain 30 can be formed with protuberances, sized to a desired width and trimmed to trim the interior welds 48 at the second forming station 60 at the same time similar operations are being performed on a succeeding section of chain at the first forming station 40.

As shown, the chain portion 70 extends downwardly with a twist to and under a guide wheel 72 and then up to a rounded chain guide 39 of the press 62 at the second forming station 60.

After the protuberance forming, width sizing and interior weld trimming of six links 47 at the second forming station 60 is performed, the index sprocket 64 at the station 60 advances finished chain 45 out of the apparatus 10 under a pulley 74 and to, and over, a driven sprocket 76 at the upper end of an arm 78 fixed to and extending upwardly from the framework 16 at the exit end 15 of the apparatus 10. From the sprocket 76, the finished chain 45 is dropped into the storage container 14.

Figure 2:
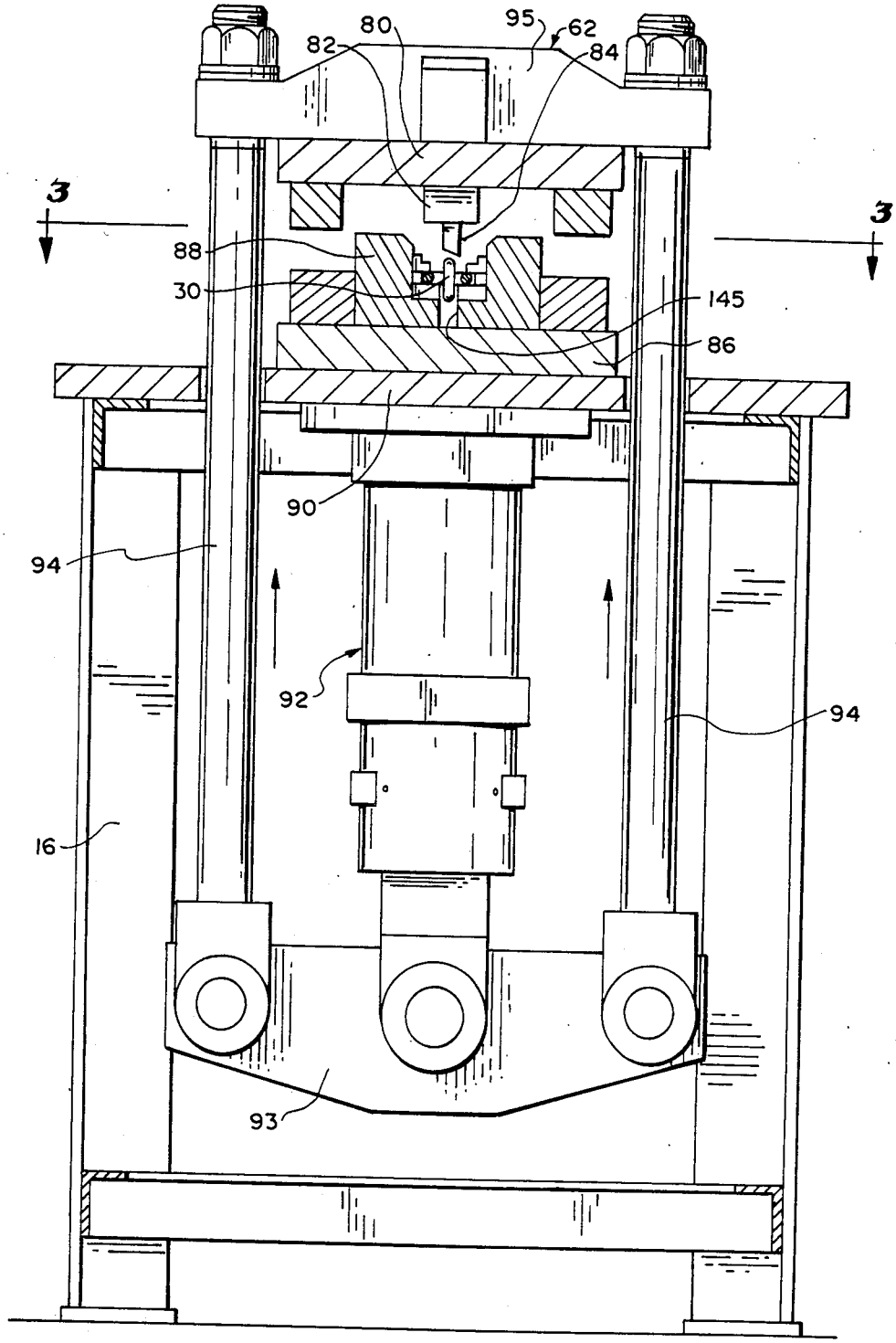
FIG. 2 is a vertical sectional view of the apparatus shown in FIG. 1, is taken along line 2—2 of FIG. 1, and shows a forming station in greater detail.

As shown in FIG. 2, the presses 62 62' include an upper die holder 80 having a die block 82 mounted thereon. Also shown in FIG. 2 is one of three trimming dies 84 depending from the die block 82 for trimming interior welds 48.

The press 62 and 62' further includes a lower die holder 86 mounting a chain guide channel 88 on a plate 90 of the framework 16.

The holder 80 is movable downwardly against the die holder 86 by a hydraulic piston 91 and cylinder 92 mechanism.

The piston 91 and cylinder 92 mechanism is suspended from the plate 90 and has a lower frame member or cylinder clevis 93 fixed to the lower end thereof. Two rods 94 extend upwardly from the frame member 93 and have mounted on their upper ends a frame member 95 from which the die holder 80 depends as shown.

It will be understood that a section of chain 30 is received in the horizontal chain guide channel 88 (FIG. 2).

Figure 6:
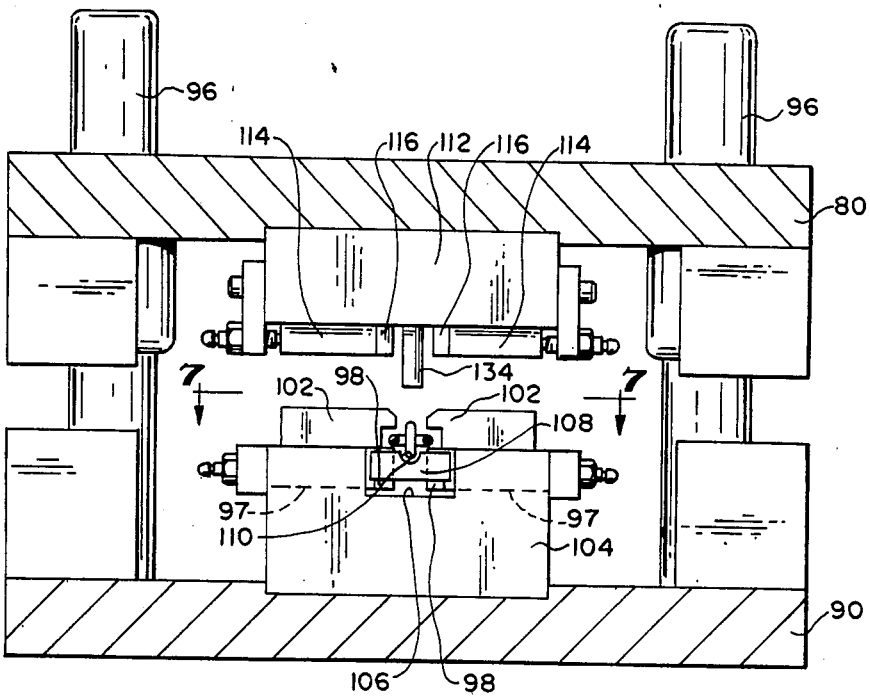
FIG. 6 is a vertical sectional view of the apparatus, is taken along line 6—6 of FIG. 3A and shows the chain in a protuberance forming press at the forming station shown in FIG. 3A.

The piston and cylinder mechanism 92 is operated in each cycle of operation of the press 62 and 62' to bring the upper die holder 80 downwardly toward the plate 90 with the holder 80 (or the frame member 95) slidable on guide rods 96 (FIGS. 1 and 6).

Referring now to FIG. 3A, there is illustrated therein the first forming station 40 comprising the die press 62 having the two work stations 42 and 44.

The first work station 42 has six lower die members 97, each of which has a semicylindrical end 98 (FIGS. 6 and 7) for forming the semicircular indentations 56 and 58 on one side of a link 46 (or 47 at the second station 60) and six upper dye members 114, each of which has a semi-circular end 116 forming the semi-circular indentations on the other side of a link 46 (or 47 at the second station 60).

Figure 7:
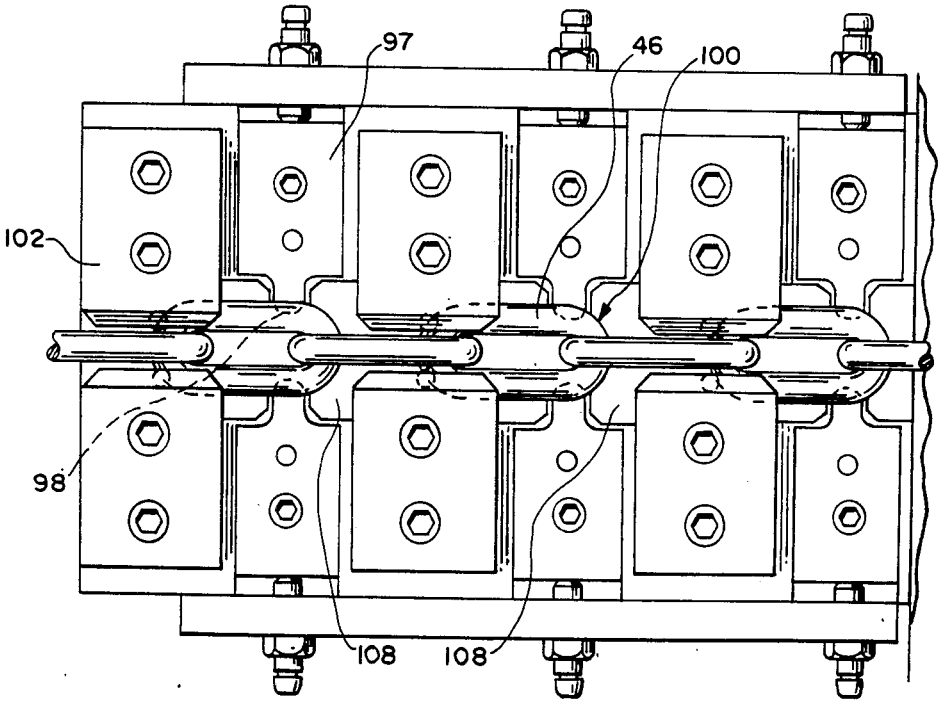
FIG. 7 is a top sectional view of the protuberance forming press shown in 6, is taken along line 7—7 of FIG. 6 and shows three (3) links being formed at one time.

As shown in FIG. 3A, FIG. 6 and FIG. 7 a section 100 of chain 30 comprising three horizontally disposed links 46 and three vertically disposed links 47 is received in the first work station 42 under guide blocks 102 and above semi-circular die ends 98.

Referring now to FIG. 6, it will be apparent that the lower die members 97 are mounted in a block 104 having a channel 106 therein in which are positioned upwardly spring biased blocks 108, each of which has a chain link receiving groove 110 for receiving vertically disposed link 47. The upper die holder 80 then has a block 112 depending therefrom which mounts six upper die members 114, each having a semicylindrical die end 116 substantially identical to and aligned with semi-circular lower die ends 98.

Figure 3B:
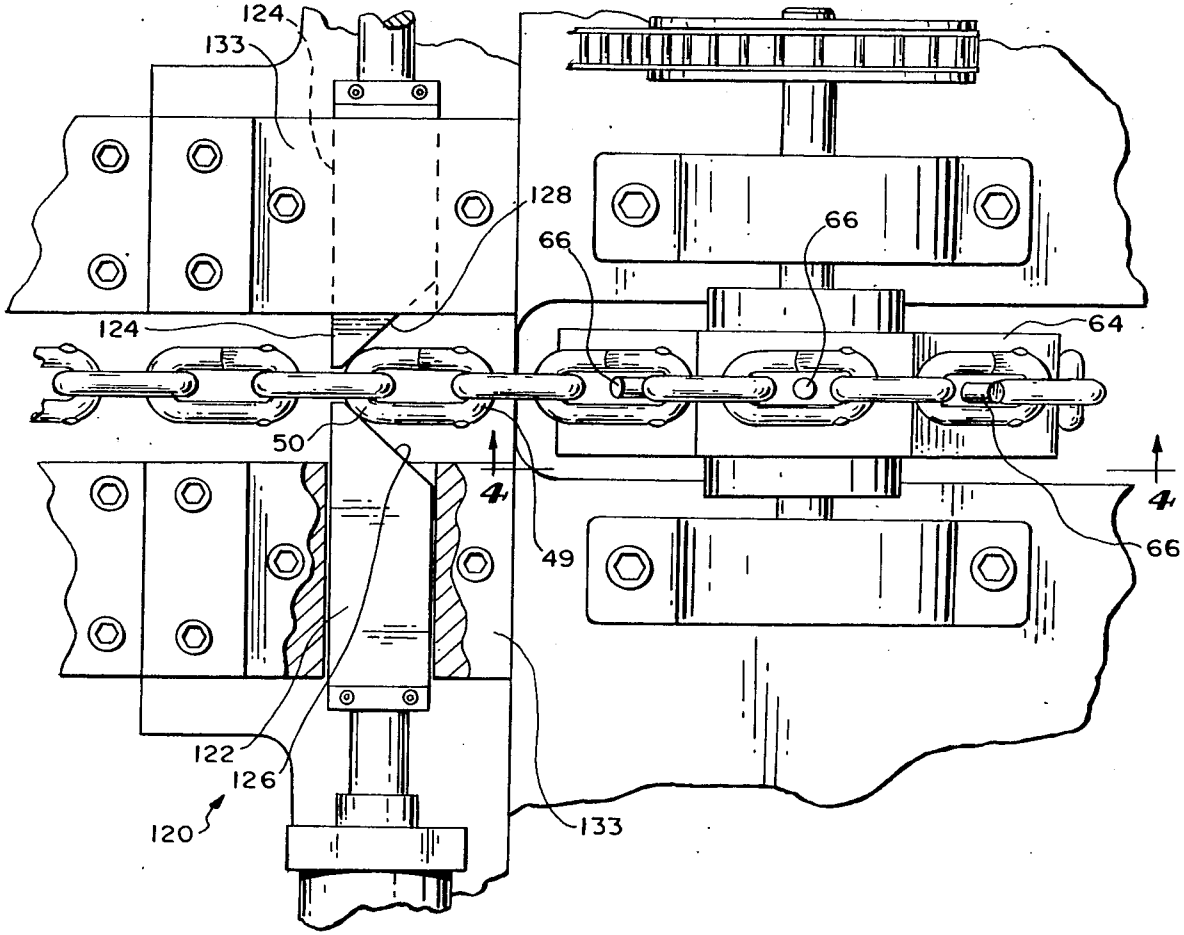
FIG. 3B is part of a horizontal sectional view, similar to the view in FIG. 3A, is taken along line 3—3 of FIG. 2, and shows positioning slides and one indexing sprocket of the apparatus shown in FIG. 1.
Figure 4:
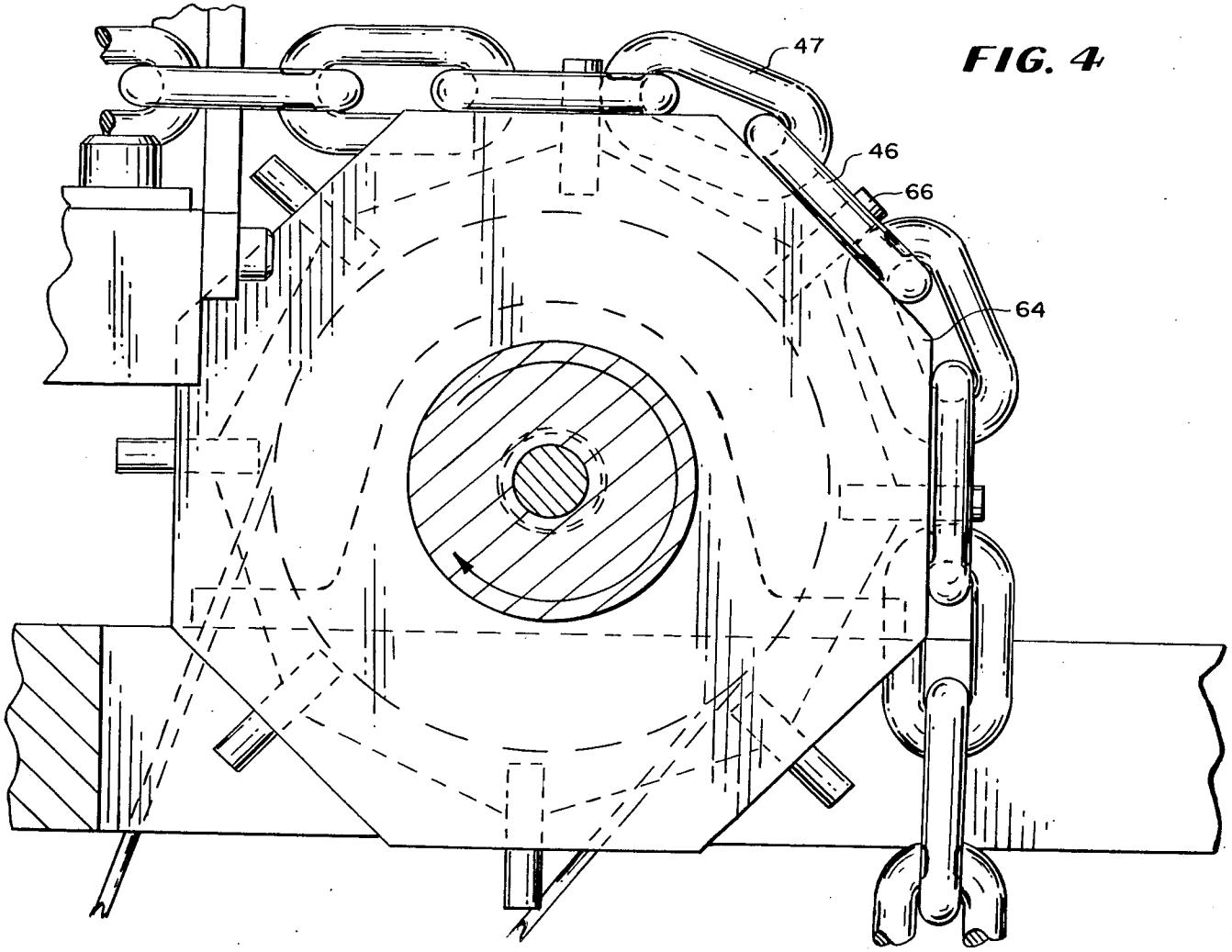
FIG. 4 is a vertical sectional view of the one indexing sprocket the apparatus of FIG. 1 and is taken along line 4—4 of FIG. 3B.

Turning now to FIG. 3B, at the downstream end of the second work station just before the indexing sprocket 64 is a chain locating mechanism 120.

The chain locating mechanism 120 includes two opposed horizontally movable slides 122 and 124, each of which has a 45° inclined edge 126 or 128 which is adapted to engage an end 50 of a link 46 (or 47 at forming station 60) to locate the chain links 46 of chain section 100 at desired positions within the first work station 42. This is accomplished by first causing the index sprocket 64 to draw the links 46 of the chain 30 slightly short of the desired link position.

Figure 5:
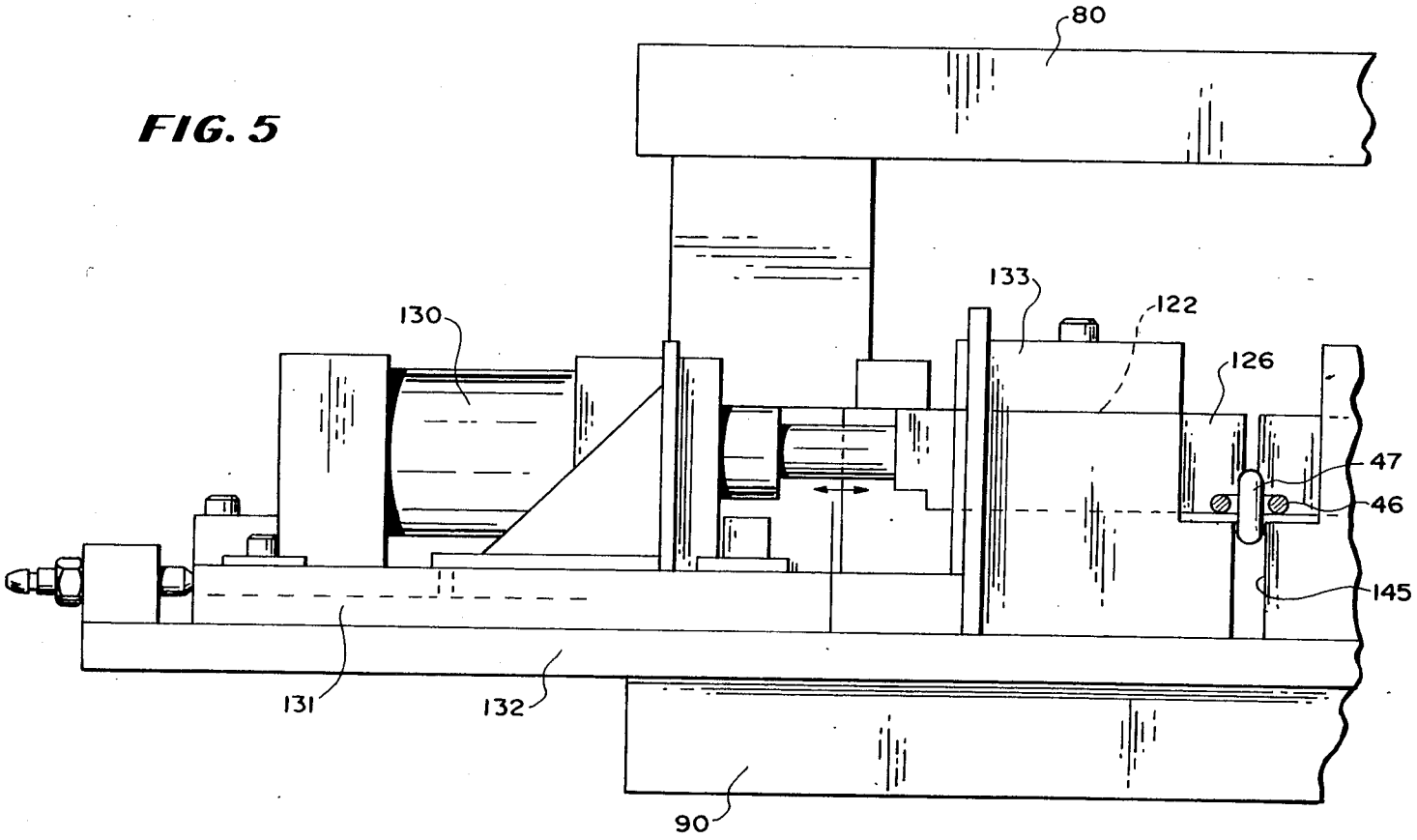
FIG. 5 is a vertical sectional view of the apparatus, is taken along line 5—5 of FIG. 3A and shows a chain exiting a trimming mechanism at the forming station shown in FIG. 3A.

Then, hydraulic cylinders 130 (FIG. 5) are activated to cause the slides 122 and 124 to move inwardly toward each other to bring the inclined edges 126 and 128 into engagement with an end 50 of a link 46 to draw the chain links 46 downstream slightly to position properly the links 46 in the chain section 100. As shown in FIG. 5, the cylinders 130 are mounted on a plate 131 horizontally adjustable on a base plate 132 mounted on the plate 90 with each slide 122, 124 slidable in a block 133.

Next a more precise positioning is achieved when the die block holder 80 is moved downwardly to cause dimple index fingers 134 (FIGS. 1 and 6) to move within the oval interior of each link 46 just prior to the pinching action of the semi-circular die ends 98 and 116 on horizontally disposed links 46. Preferably, finger 134 shown in FIG. 1 is spring loaded.

Figure 9:
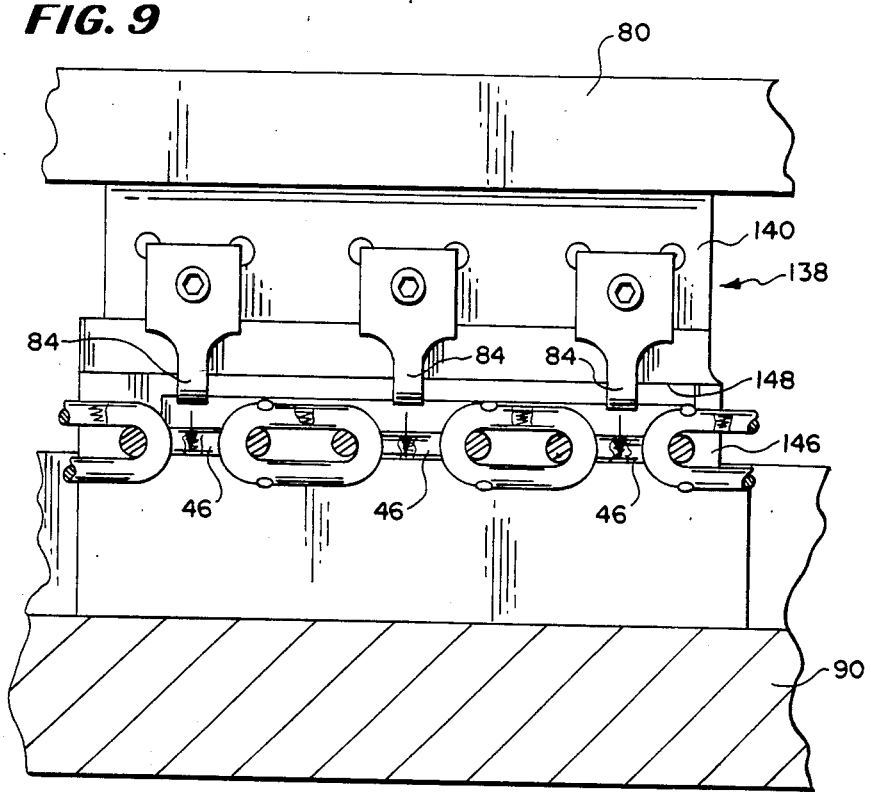
FIG. 9 is a vertical sectional view taken along line 9—9 of FIG. 3A.

Returning now to FIG. 3A, and with reference to FIG. 9, the second work station incudes a link width sizing mechanism 136 and an interior link weld trimming die assembly 138 (FIG. 9) comprising three spaced apart cutting dies 84 mounted to and extending downwardly from a block 140 fixed to the underside of die block holder 80.

Figure 8:
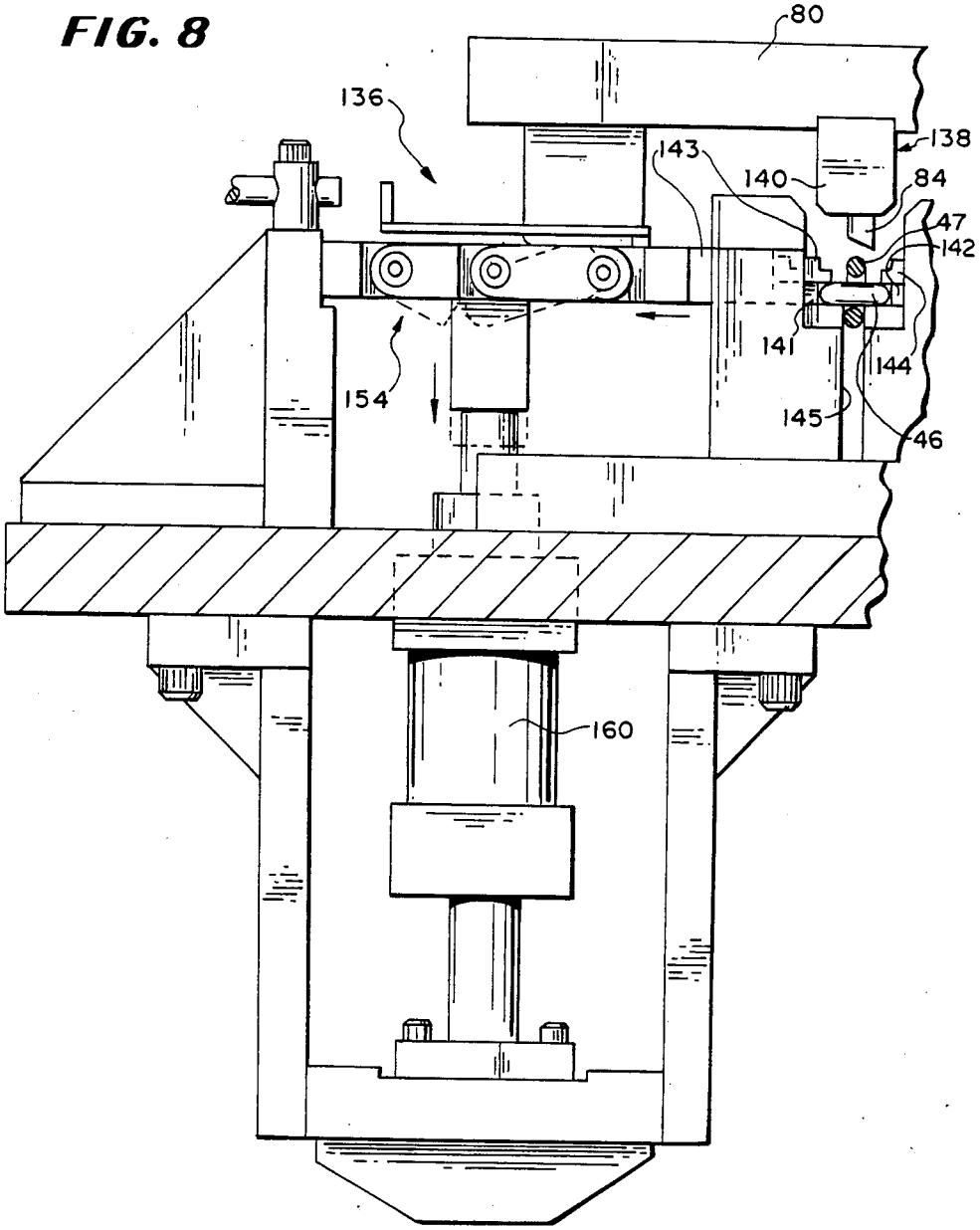
FIG. 8 is a vertical sectional view of the apparatus, is taken along line 8—8 of FIG. 3A and shows the chain exiting a second work station at the forming station shown in FIG. 3A.

The sizing mechanism 136 includes two opposed horizontally slidable die plates 141 and 142 (FIG. 8) fixed to and beneath die plate holders 143 and 144 which are slidable horizontally toward each other so that the plates 141 and 142 can engage laterally outwardly facing sides of the side sections 51 and 52 of three links 46. Vertically oriented links are received in a channel 145 (FIG. 5) between two blocks 146 and 147 at the second work station 44. The blocks 146 and 147 form part of the sizing mechanism 136 and each has a slot (e.g. slot 148 in block 147 shown in FIG. 9) in which a die block 143 or 144 is received. Each die plate 141 and 142 has a sizing edge 151, 152 which has three recesses therein (not shown) for accommodating protuberances 53 or 54 when the die plates 141 and 142 are moved inwardly to press against the laterally outwardly facing sides or side sections 51 and 52 to squeeze the horizontally oriented links 46 (or links 47 at the second station 60) to size them with a predetermined width.

The sizing mechanism 136 includes not only die plate holder 143 and 144, die plates 141 and 142 and blocks 146 and 147 but also toggle mechanisms 154 and 156 which are operated by cylinders 160 (FIG. 8), the operation of which are synchronized with the movement of the die press 62. In this respect, the slide die plates 141 and 142 are moved toward each other at the same time the die press 62 moves downwardly to cause the trimming dies 84 to trim excess weld of the welds 48 within the interior of the links 46.

It will be understood that the links 47 are formed with protuberances 53 and 54, sized with a proper desired width and trimmed of excess weld 48 within the oval interior of each link 47 at the forming station 60, after the chain portion 70 has been trained in a twisted manner from first forming station 40 to the second station 60.

Preferably after the protuberances 53 and 54 are formed in the links 46, the finished chain 45 is heat treated to an austenization temperature of 1650° to 1725° F. in a first induction coil and then subjected to an immediate quench of cold water or oil. The finished chain 45 is then processed through a second induction coil and heated to a temperature below the austenization temperature (typically between 300° and 900° F.) to stress relieve the chain 45 and achieve specific physical and mechanical properties followed by a water cooling of the finished chain 45.

It will be understood that in the operation of the apparatus or machine 10, the chain 30 is fed through the sensor 24, and other sensors not described in detail, which check for twisted, knotted or improperly trimmed chain 30, 70 or 45. If any chain is found to have these abnormalities, the apparatus 10 is automatically shut off.

The presses 62, each comprising a work station/-protuberance forming press 42, and a work station 44 including the trimming assembly 138 and the sizing mechanism 136 are hydraulically driven while the index sprockets 64 are driven by an electric motor.

The two presses 62 at the two forming stations 40 and 60 are operated alternately. In other words, when one press 62 is making protuberances, sizing and trimming, the other press 62 is indexing the chain 30.

The sequence of operations is controlled by a programmable controller or microprocessor which is fed information from various proximity sensors positioned throughout the apparatus 10.

The apparatus 10 operates at a rate of 17 cycles per minute and feeds six links 46 (or 47) per cycle. This provides a processing rate of 102 of one type link per minute.

From the foregoing description it will be apparent that the apparatus or machine 10 is operable to:

form protuberances the chain links 46 and 47 in two places adjacent the end 50 of each link, the indentations semicircular indentations 56 and 58 causing material of the link to be moved laterally outwardly thereof to form the protuberances 53 and 54;

control the outside width of the links 46 and 47 as well as the outside width of the protuberances 53 and 54 with the sizing mechanism 136; and, trim the inside of the weld or welded area 48 of each link 46 and 47.

In the operation of the apparatus 10, the following cycle takes place:

1. The presses 62 are in an open position with the cylinder clevis 93 against a stop at the lower end of cylinder 92 (FIG. 1). The sizing plates 141 and 142 and associated plate holders 143 and 144 are retracted. Also, the positioning slides 122 and 124 are retracted.

2. The index sprocket 64 turns to pull the chain 30 through the channel 145. A sensor positioned above the chain 30 senses links 46 (or 47) passing thereunder. When an appropriate number of links 46 are advanced, the index sprocket 64 is stopped so that chain 30 is fed a little short of its final position in the die presses 62.

3. The link positioning slides 122 and 124 move in from each side of the chain 30 until they reach a stop (not shown). The 45° surfaces 126 and 128 squeeze against the rounded end 50 of one link 46 (or 47) from each side forcing the chain 30 from its final position. This movement then signals for the next operation to begin.

4. The sizing plates 141 and 142 come in horizontally from each side and close against the three links 46 (or 47) which have just been formed with protuberances in the previous cycle. The purpose of this operation is to control the outside width of the links 46 (and 47) and the outside width over the protuberances 53 and 54 by collapsing the links 46 (and 47) and protuberances 53 and 54 to a predetermined dimension.

5. While the sizing plates 141 and 142 are sizing and holding three links 46 (or 47) the upper half of the die press 62 starts downward. This movement does three things:

(a) the adjustable locating fingers 134 attached to the plate 80 come into contact with the section 100 of the chain 30 which is behind the sizing plates 141 and 142 and thus free to move. These fingers 134 will give the chain 30 enough push or pull to finally locate each link just before the semicircular ends 116 and 98 of the dimpled dies 114 and 97 come into contact with the links 46 of the chain 30. One of the fingers 134 is spring loaded so that it puts some tension in the chain to stretch it out and make sure there is no slack in the chain 30.

(b) The semi-circular die ends 98 and 116 now come into contact with three of the horizontal chain links 46 right behind the sizing plates 141 and 142 and the upper dies 114 continue downwardly to squeeze or pinch the links 46 until the top die plate 80 comes against a stop. This causes the chain links 46 to be formed with the indentations 56 and 58 and with the protuberances 53 and 54.

(c) In the same down movement, the trimming assembly 138 attached to the top die plate 80 comes into contact with the horizontal links 46 being held in position by the sizing plates 141 and 142. The trimming dies 84 of the assembly 138 trim any weld protruding on the inside of each of the links 46 held by the sizing plates 141 and 142 and the trimmed chips fall out to the bottom of the die press 62.

6. After the die plate 80 is held against its lower stop for a period of time, it is released and moved back upwardly to and against its upper stop. At the same time, the sizing plates 141 and 142 are retracted and the cycle begins again.

Manual operation buttons are provided on a control panel for the apparatus or machine 10 to allow it to be cycled to an operation manually.

From the foregoing description, it will be apparent that the apparatus 10 of the present invention and the method for using same have a number of advantages, some of which have been described above and others of which are inherent in the invention.

Also it will be apparent that modifications can be made to the apparatus 10 and the method for using same without departing from the teachings of the present invention. Accordingly, the scope of the invention is only to be limited as necessitated by the accompanying claims.

I claim:

1. A method for producing oriented, one-way links from a stock chain of the type including oval shaped links each having first and second rounded ends and parallel spaced straight side sections formed in a continuous loop having an interior space and an exterior surface, said method comprising the steps of:

moving the chain to a first forming station;

forming protuberances in each straight side section adjacent the first end of at least a single first link at said first station, the protuberances extending laterally outwardly from the exterior surface of at least one first link;

moving the chain to a second forming station;

rotating the chain;

forming protuberances on each straight side section adjacent the first end of at least a single second link orthogonal to the first link at said second station the protuberances extending laterally outwardly from the exterior surface of at least one second link; and repeating the above step until all links of the chain have protuberances formed thereon.

2. The method of claim 1 further comprising the step of forming the three first links in the same plane with protuberances at said first forming station.

3. The method of claim 1 further comprising the step of forming three second links which are orthogonal to the three first links with protuberances at said second forming station.

4. The method of claim 1 further comprising the step of sizing the width of at least one first link having already had protuberances formed thereon at said first forming station to a desired width at a downstream section of said first forming station while a succeeding first link, in the same plane as the formed first links, is having protuberances formed thereon, both operations taking place at first forming station.

5. The method of claim 4 further comprising the step of removing any weld extending interiorly from one of side sections of the first link with protuberances already formed thereon by trimming from said first link at the downstream section of said first forming station and at the same time the width of said first link is being sized at the downstream section of said first forming station.

6. The method of claim 1 including the steps of:

initially locating the links short in the first forming station;

engaging the rounded upstream second end of a first link and accurately positioning same;

and more precising positioning at least one first link to be formed with protuberances thereon at an upstream section of said first forming station.

7. The method of claim 6 wherein said initial locating of the chain is accomplished by an indexing sprocket wheel which brings the chain links up short of the desired position.

8. The method of claim 6 wherein said accurate locating is accomplished by opposed locating slides each of which has an inclined 45° angle face which are caused to engage the second upstream end of one first link of the chain.

9. The method of claim 6 wherein the upstream section includes a first work station including a protuberance forming press and said method comprises the steps of:

forming indentations in at least one first link to squeeze material laterally outwardly therefrom to form the protuberances.

10. The method of claim 9 wherein said step of more precisely locating at least one first link is accomplished with one or more depending locating fingers which extend into the open area of one or more first links at the upstream section of the first forming station for precisely locating at least one first link therein while indentations are formed in that first link to form the laterally outwardly extending protuberances.

11. The method of claim 10 further comprising the step of applying tension to at least one first link by the use of a spring biased finger.

12. The method of claim 1 wherein said chain is rotated between said first and second stations by passing the chain around a wheel and initially imparting a 90° twist to the chain from its orientation at it exists from said first forming station to its orientation as it enters said second forming station.

13. An apparatus for producing oriented, one-way links from a stock chain of the type including oval shaped links each having first and second rounded ends and parallel spaced straight side sections, said apparatus comprising:

a first forming station;

means form moving the chain to said first forming station;

means for forming protuberances in each straight side section adjacent the first end of at least a single first link at said first station, the protuberances extending laterally outwardly from at least one first link;

a second forming station;

means for moving the chain to said second forming station; and means for forming protuberances on each straight side section adjacent the first end of at least a single second link orthogonal to the first link at said second station, said protuberances extending laterally outwardly from at least one second link.

14. The apparatus of claim 13 being capable of forming protuberances on three links on the same plane at said first forming station.

15. The apparatus of claim 13 being capable of forming protuberances or three second links orthogonal to said first links at said second forming station.

16. The apparatus of claim 13 comprising means for sizing the width of at least one first link having protuberances formed therein at said first forming station to a desired width at a downstream section of said first forming station while a succeeding first link, in the same plane as the first formed links, is having protuberances formed thereon, both operations taking place at said first forming station.

17. The apparatus of claim 16 comprsing means for trimming any weld extending interiorly of said first link with protuberances formed thereon from one of said side sections of that first link at the downstream section of said first forming station and at the same time that said first link width is being sized to a desired width at the downstream section at the first forming station.

18. The apparatus of claim 13 including:

means for initially locating the links short in said first forming station;

means for engaging the rounded upstream second end of a first link and accurately positioning same;

means for more precisely positioning at least one first link to be formed with protuberances thereon; and at an upstream section of said first forming station.

19. The apparatus of claim 18 wherein said means for initially locating the chain links short comprises an indexing sprocket wheel which brings the chain links up short of the desired position.

20. The apparatus of claim 18 wherein said accurate locating means comprise opposed locating slides each of which has an inclined 45° angle face and means for causing said faces to engage the second upstream end of one first link of the chain.

21. The apparatus of claim 18 wherein:

said upstream section includes a first work station including press for forming protuberances and said apparatus further comprises means for:

forming indentations in at least one first link to squeeze material laterally outwardly therefrom to form the protuberances.

22. The apparatus of claim 21 wherein:

said more precise locating means includes one or more depending locating fingers which extend into the open area of one or more first links at the upstream section of said first forming sections for precisely locating at least one first link therein while indentations are formed in said first link to form laterally outwardly extending protuberances.

23. The apparatus of claim 22 wherein one of said fingers is spring biased to apply tension to the at least one first link.

24. In a machine for forming laterally outwardly extending protuberances in parallel spaced side sections of an oval shaped first chain link adjacent one rounded end of the first link, the improvement comprising means at a forming station for sizing the width of at least one first link formed with protuberances thereon to a desired width while at the same time a succeeding first link in the same plane of the formed first link is formed with laterally outwardly extending protuberances in the side sections thereof by protuberance forming means also at said forming station.

25. The machine of claim 24 further comprising a die press wherein said forming means and said sizing means are part of said die press.

26. The machine of claim 25 wherein said forming station includes an upstream section and a downstream section, said sizing means being located at said downstream section, and said machine further including trimming means at said downstream section for trimming weld material extending inwardly of the first link being sized to a predetermined width from a side section of that first link at the same time that that first link is being sized by said sizing means.

* * * * *